US007395572B2

(12) United States Patent
Scita

(10) Patent No.: US 7,395,572 B2
(45) Date of Patent: Jul. 8, 2008

(54) ROTATING BRUSH CONTROLLING APPARATUS IN A FLOOR SWEEPING MACHINE

(75) Inventor: Michele Scita, Fidenza (IT)
(73) Assignee: Dulevo International S.p.A., Parma (IT)

( * ) Notice: Subject to any disclaimer, the term of this patent is extended or adjusted under 35 U.S.C. 154(b) by 768 days.

(21) Appl. No.: 10/854,283

(22) Filed: May 27, 2004

(65) Prior Publication Data

US 2004/0237231 A1 Dec. 2, 2004

(30) Foreign Application Priority Data

May 29, 2003 (IT) ..... MI2003A1080

(51) Int. Cl.
*E01H 1/02* (2006.01)
*E01H 1/05* (2006.01)
*A47L 11/18* (2006.01)
*A47L 11/24* (2006.01)

(52) U.S. Cl. ..... 15/52.1; 15/49.1; 15/82; 15/340.3

(58) Field of Classification Search ..... 15/52.1, 15/49.1, 78, 82, 87, 98, 340.3, 340.4; 451/177, 451/178
See application file for complete search history.

(56) References Cited

U.S. PATENT DOCUMENTS 3,510,900 A 5/1970 Roslund
3,790,981 A 2/1974 Young
4,138,756 A * 2/1979 Krier et al. ..... 15/83
4,674,142 A * 6/1987 Meili ..... 15/49.1
4,785,715 A * 11/1988 Bosniac ..... 91/514

FOREIGN PATENT DOCUMENTS

DE 1 026 771 3/1958
EP 0 795 647 A1 9/1997

* cited by examiner

*Primary Examiner*—Gary K Graham
(74) *Attorney, Agent, or Firm*—Browdy and Neimark

(57) ABSTRACT

Provision is made for a rotating brush controlling apparatus (8) in a floor sweeping machine (1), comprising: a lifting device (15) suitable for applying a lifting force (15*a*) which is capable of lifting a rotating brush (8) to remove the same from a surface to be swept (7), and an actuating device-(16) which is suitable for applying a working force (16*a*) on command against the lifting force (15*a*), where the rotating brush (8) and the actuating device (16) are linked to each other and where moreover some adjusting devices (24) are provided, which are suitable both for optionally selecting the working force (16*a*) to selectively force the rotating brush (8) on the surface (7) to be swept, and for keeping the working force (16*a*) substantially constant in the presence of irregularities in the surface to be swept (7).

9 Claims, 4 Drawing Sheets

1
2
2b
3
4
5
5a
5b
6
6a
7
8
8a
9
10
10a
10b
11
12
14a
14b
15
15a
16
16a
25
29
30
33

ROTATING BRUSH CONTROLLING APPARATUS IN A FLOOR SWEEPING MACHINE

FIELD OF THE INVENTION

The invention relates to a rotating brush controlling apparatus in a floor sweeping machine, and comprising: at least one lifting device suitable for applying a lifting force capable of lifting said rotating brush to remove the same from a surface to be swept, and at least one actuating device suitable for applying on command a working force opposed to said lifting force, and exceeding the same.

DESCRIPTION OF THE PRIOR ART

As known, the sweeping machines may be of a small and a medium size and be suitable for the cleaning of warehouses, commercial centres, sheds, industrial centres and the like.

The small to medium size machines are also suitable for occasional uses, for instance for a short period after the closing of a commercial centre, and are on various occasions used by operators that are only occasionally taking control of them.

These relatively inexperienced operators with a limited knowledge of the characteristics of these machines and of the relative cleaning techniques may incur in mistakes and encounter difficulties in steering and controlling the machines. At the end of the work, for instance, an incomplete deactivation of the roller or cup-type cleaning brushes working the floor may occur.

At the end of the cleaning operations and prior to moving the machine toward an area for discharging the collected dirt and/or for storing it in a depot, the brushes must both be arrested and lifted, because if they are arrested but left in a lowered position while the machine moves on for relocating, considerable and irregular bristle wear occurs on the brushes.

The patent EP 0 795 647 by the same applicant discloses a vehicle in which the lifted position of the brushes at work's end is obtained by appropriate lifting springs, which are potentially always active and forcibly and automatically deactivated when the machine is operating, so as to leave the brushes free to contact the ground. When the work is over, the springs can automatically act to lift the brushes.

A widely encountered usage problem is also related to fact that the floors of warehouses, commercial centres and the like may exhibit small steps, contours or differences in height, for instance between different departments, or because of the passing of cables or other.

In order to allow the brushes to adapt to the contours and small steps, the same are often allowed to freely move in a vertical sense while working, and essentially left to be governed by their own weight.

This is for instance the technical solution also adopted in the patent EP 0 795 647 by the same applicant, and endows the brushes with a great flexibility of use.

Nevertheless, this also generates the drawback that when the brushes swing in a vertical sense, they easily lose adherence and leave certain swept areas in an unsatisfactory condition.

The hollowed areas and small recesses are also swept out to a limited degree, if the brushes are partially kept raised by higher areas. Alternatively, the brushes are tied up so as to prevent them from oscillating freely, but in this case the steps and contours on the surface to be swept are leading to shocks and difficulties in operating the machines.

Only a careful and experienced operator can remedy these shortcomings, by taking action with repeated passes and appropriate changes of direction of the brushes opposite the steps, differences in height and recesses.

The operators are also required to use these machines with particular skill in other cases, by taking action repeatedly and/or at appropriate speeds on particular surface stretches to be swept, or by mounting special brush types or spreading special detergents over the floors. The floor cleaning of warehouses, commercial centres, sheds, industrial centres and the like in fact demands that the same be performed in depth, even when soiling materials are to be removed. For instance, it may be necessary to remove not just easily picked-up dust and refuse, but—on a local basis—also liquids, oily substances, colours, hydrocarbon residues, food residues etc., which potentially adhere to the floors to be cleaned. It is nevertheless evident that no special skill can be demanded from operators that only occasionally take control of said sweeping machines, and that a sweeping machine allowing to achieve optimum results without engaging an operator in complex manoeuvres is therefore welcome and desirable.

SUMMARY OF THE INVENTION

In this situation the technical aim of this invention is to conceive a rotating brush controlling apparatus in a floor sweeping machine, capable of overcoming the mentioned drawbacks, and in particular of achieving optimum cleaning results even in areas difficult to handle and in the presence of substances not easily removed, without demanding special skills from the personnel in charge.

The technical aim is achieved by a rotating brush controlling apparatus, in a floor sweeping machine, comprising: at least one lifting device suitable for applying a lifting force capable of lifting said rotating brush to remove the same from a surface to be swept, and at least one actuating device suitable for applying on command a working force opposed to said lifting force and exceeding the same, where said rotating brush and said actuating device are linked to each other and adjusting devices are available to optionally select one such working force, so as to selectively force said rotating brush on said surface to be swept.

BRIEF DESCRIPTION OF THE DRAWINGS

A description of a preferred embodiment of the apparatus according to the invention is now given as shown in the enclosed drawings, in which.

DETAILED DESCRIPTION OF THE PREFERRED EMBODIMENTS

Figures 1, 2, 3:
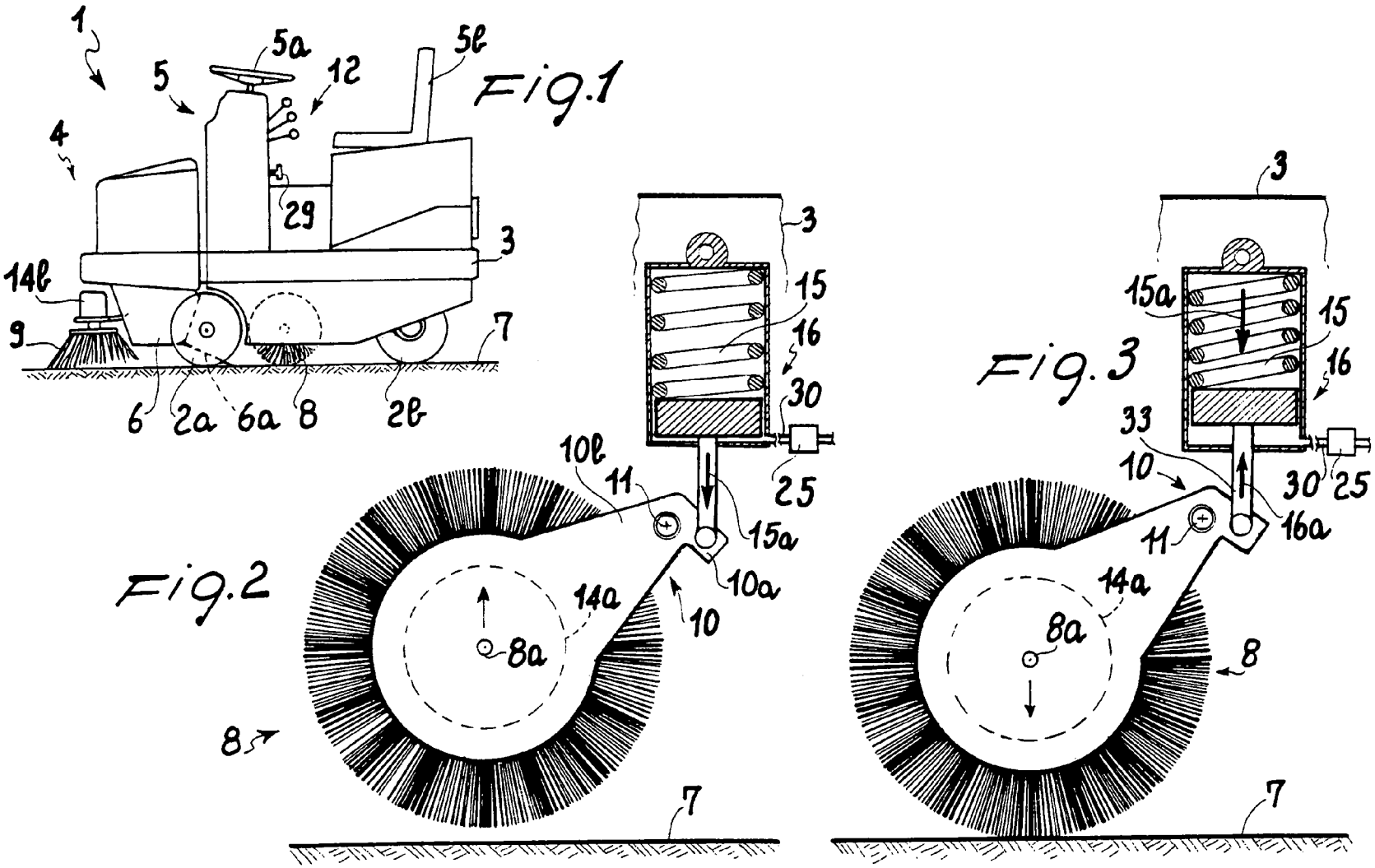
FIG. 1 shows, schematically and as a whole, a raised view of a sweeping machine of medium size, with brushes governed by the controlling apparatus according to the invention.
FIG. 2 shows a roller brush in a lifted resting position.
FIG. 3 shows the roller brush of FIG. 2 in a working position, based on the action of the apparatus according to the invention.

With reference to the mentioned figures, the apparatus according to the invention is inserted in a sweeping machine indicated as a whole by the number 1.

It comprises, in a manner in itself known, two front wheels 2*a* and one or two rear wheels. In the case of a single rear wheel 2*b*, the same is both a driving and a steering wheel.

The wheels 2*a*, 2*b* sustain a frame 3 supporting collecting organs 4 for dust and refuse, and moving devices 5 for the vehicle 1.

The collecting organs 4 comprise a container 6 for accumulating dust and refuse.

The container 6 is substantially placed between the front wheels 2*a* and fitted with an opening and closing door 6*a* which is also suitable for fulfilling the function of a slide for inserting the dust and refuse in the container 6.

The collecting organs 4 further comprise one or more rotating brushes suitable for operating on a surface to be swept 7. In the preferred embodiment shown here, several rotating brushes are present: a central brush 8 and at least one and preferably two auxiliary brushes 9.

The central brush 8 is a substantially cylindrical roller brush having a rotating axle 8*a* substantially parallel to the surface to be swept 7. The brush extends in practice over the entire length of the machine 1. The auxiliary brushes 9 are instead profiled as a cup or as a truncated cone and exhibit a rotating axis across the surface 7.

The auxiliary brushes 9 can be positioned in front of the machine 1, on the right side and on the left side of the same, so as to convey the dust and refuse from the sides toward the central area of the machine, which holds the central brush 8. FIG. 1 shows the auxiliary left front brush 9 only.

It is possible to arrange for only a single auxiliary brush 9, eventually capable of oscillating on command between the left side and the right side.

When the door 6*a* is lowered as shown in FIG. 1 and the container 6 is open, the central brush 8 flings the dust and refuse, that has been conveyed to it by the auxiliary brushes 9, inside the container 6.

The collecting organs 4 further comprise an aspirating fan, not shown here, which is placed upstream of the container 6 and suitable for aspirating the air from the container 6 itself, through an interposed filter, both to prevent the dust of the container from escaping into the surrounding environment, and to achieve an effective aspirating function reaching down to the level of the surface to be swept 7.

The frame 3 supports at least part of the rotating brushes in an oscillating manner, so as to allow the rotating brushes themselves to rise and fall with respect to the surface to be swept 7.

As shown in detail in the FIGS. 2 and 3 in reference to the central roller brush 8, and as better explained in the following, at least the central brush 8 is in fact engaged by a lever 10 supported in a rotating manner by a fulcrum 11 connected to the frame 3.

In order to actuate and control the wheels 2*a* and 2*b* of the machine 1, the moving devices 5 comprise steering instruments in themselves known, of whose the steering wheel 5*a* and its relative control station 5*b* are shown in FIG. 1, and a traction device, in itself known, which is equipped with a motor, for example an internal combustion or an electrical one.

In order to control the collecting organs 4, and in particular the rotating brushes, the machine 1 exhibits a controlling apparatus 12, which forms the specific object of this invention.

The controlling apparatus 12 includes mainly a lifting device 15 capable of applying a lifting force 15*a* suitable for lifting at least one rotating brush, in particular at least the central brush 8, so as to remove the same from the surface to be swept 7.

The lifting device 15 is preferably carried out with elastically deformable organs, such as at least a spring.

While working, the lifting device 15 is neutralized by at least one actuating device 16 suitable for applying a working force 16*a* opposing the lifting force 15*a*. Moreover, provision is made for at least the central brush 8 and at least one actuating device 16 to be cinematically linked to each other—meaning that a motion of one of them also entails a simultaneous motion of the other—and that the working force 16*a* be selectively greater than the lifting force 15*a*, in order to neutralize the lifting device 15 and to simultaneously force the central brush 8, in a selected manner, on the surface to be swept 7.

Some adjusting devices 24, suitable for optionally selecting the working force 16*a*, are in fact provided. In particular, the adjusting devices 24 comprise at least one adjusting unit 25 suitable for adjusting the working force 16*a* and a control-wheel 29 acting on the adjusting unit 25 and placed matching the sweeping machine controls.

Provision is also made for the adjusting unit 25 to be suitable not merely for adjusting the working force 16*a* on command, but also for keeping a substantially constant working force 16*a* in the presence of irregularities on the surface to be swept 7.

In the specific embodiment shown in the drawings, the apparatus 12 comprises a fluid-dynamic system 13 suitable for circulating a pressurized fluid (for instance air, water or oil), which is the pressurized fluid activating the fluid-dynamic motors, in particular a first fluid-dynamic motor 14*a* (FIGS. 2, 3 and 4), a second fluid-dynamic motor 14*b* (FIGS. 1 and 4) and an eventual further fluid-dynamic motor 14*c* (FIG. 4), selectively suitable for controlling the rotation of the rotating brushes, one for each of the rotating brushes in question.

The first motor 14*a* is acting on the central brush 8, while the second and the third fluid-dynamic motors 14*a* and 14*c* act on the two lateral brushes 9. It is however noted that the third fluid-dynamic motor 14*c*, which is provided for the second lateral brush 9, is shown as a dashed line in FIG. 4, because the second lateral brush may be omitted, as already explained.

Figure 4:
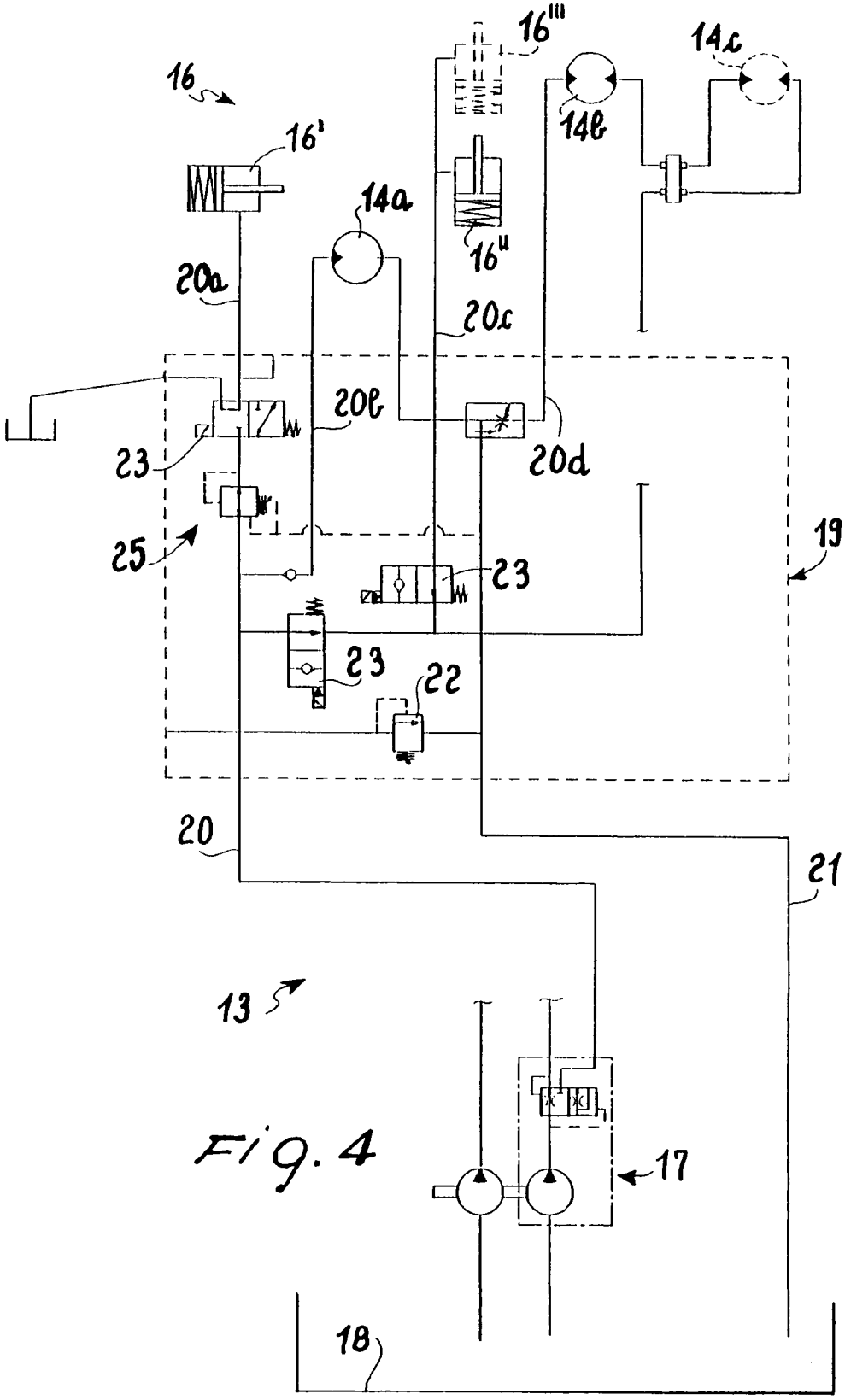
FIG. 4 shows a fluid-dynamic system of the sweeping machine of FIG. 1, used to control the position of the brushes.

There are further provided as many actuating devices 16 as there are rotating brushes, and said devices are fluid-dynamic cylinders selectively indicated by 16', 16", 16'" in FIG. 4, and supplied by the fluid-dynamic system 13.

An adjusting unit 25 interposed between the cylinder 16 itself and the fluid-dynamic system 13 is provided opposite each actuating device or fluid-dynamic cylinder 16.

More in detail, the fluid-dynamic system 13 is preferably of a hydraulic oil type and as illustrated in FIG. 4.

This system provides for at least one pump 17 which on one side connects to a hydraulic oil collecting tank 18, and on the opposite side connects to a group of elements or block 19 comprising, among other things, various circuit branches, various electrical distributors and various valves.

In particular, the block 19 in turn supplies the three fluid-dynamic motors 14*a*, 14*b*, 14*c* and the three fluid-dynamic cylinders 16', 16", 16'", respectively.

In block 19—which obeys fluid-dynamic layouts in themselves known—provision is made for a discharge channel 20 deriving from the pump 17 and a return channel 21, connected to the collecting tank 18.

A maximum pressure valve 22 is arranged between the channels 20 and 21, which directly discharges the hydraulic oil supplied by the pump 17, whenever necessary.

Downstream of the top pressure valve 22, the discharge channel 20 splits up into various branches: a first branch 20*a*, supplying the first fluid-dynamic cylinder 16', a second branch 20*b* supplying the first fluid-dynamic motor 14*a*, a third branch 20*c* supplying the first and the second fluid-dynamic cylinders 16" and 16'" in series, and a fourth branch 20*d* supplying the second and third fluid-dynamic motors 14*b* and 14*c* in series.

Further branches and elements for eventual further brushes may be arranged downstream of the third fluid-dynamic motor 14*c*, the circuit is therefore shown as being partially interrupted.

The number 23 indicates the electrical distributors that are—on command—controlling the flow of the hydraulic oil opposite said branches.

Figure 5B:
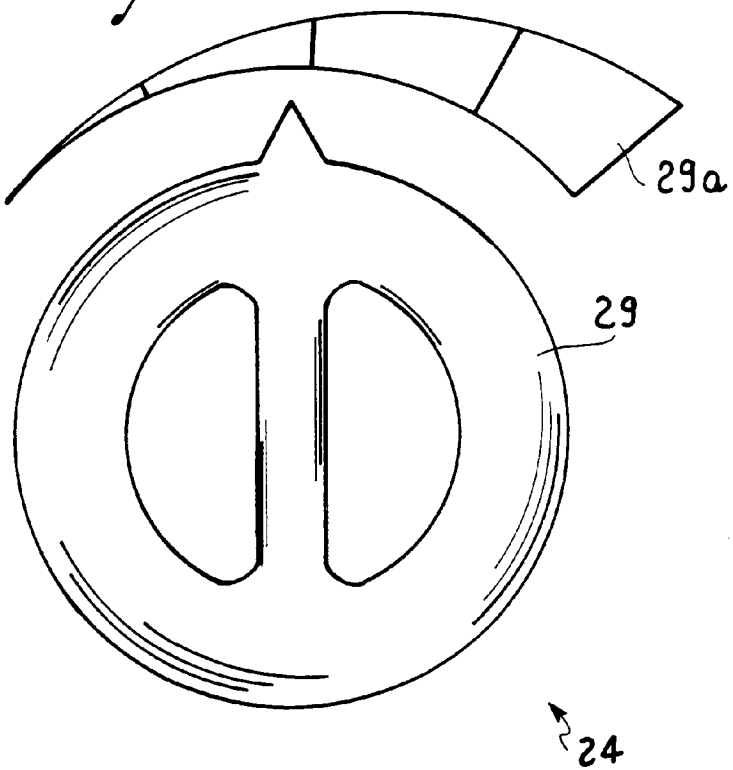
FIG. 5*b* shows a control of the adjusting valve of FIG. 5*a;*
Figure 5A:
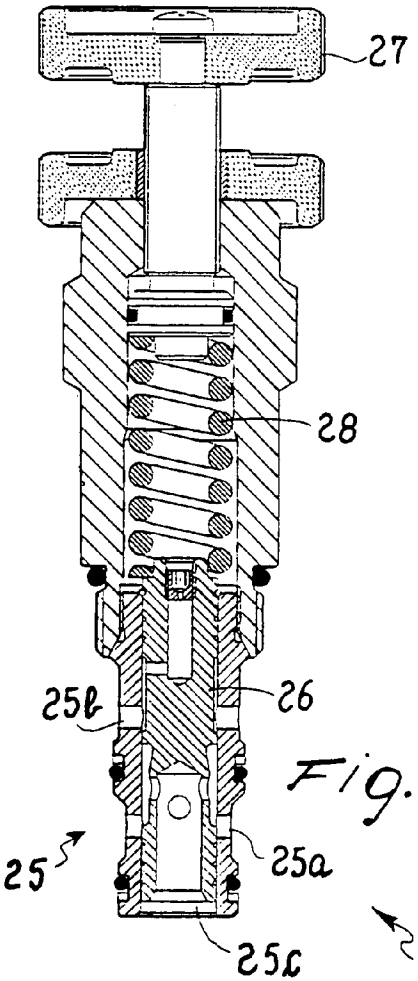
FIG. 5*a* shows a cross section of the structure of an adjusting valve.

As already said, the adjusting devices 24 comprise adjusting units 25, as illustrated in detail and in cross section in FIG. 5*a*, and at least one adjusting control 29, as shown in FIG. 5*b*.

Each adjusting unit 25 is suitable for establishing—in the respective fluid-dynamic cylinder 16—a selected working pressure. The mentioned working force 16*a* depends on said working pressure.

A further characteristic of the adjusting unit 25 is that of keeping the selected working pressure substantially constant for the respective fluid-dynamic cylinder 16 in the presence of any irregularities of said surface to be swept 7.

The adjusting unit 25 is in practice an adjusting valve of a type known as a "Pressure Reducing and Relieving Valve", or in short as a "Relieving Valve", which is placed at least opposite the branch 20*a* of the circuit 13.

Said valve has a cylindrical profile, a mouth 25*c* and a small internally mobile piston 26 for the oil pressure; the oil pressure shifts the small piston 26, that in sliding allows a selective passing of the oil across appropriate openings 25*a*, 25*b*.

A screwable knob 27 adjusts the mobility of the small piston and its resistance to motion and an adjusting spring 28 interposed between the knob 27 and the small piston 26.

A greater or lesser screwing action of the knob 27 determines in practice, through a greater or lesser compression of the adjusting spring 28, the working pressure at which the oil is allowed to pass to the respective fluid-dynamic cylinders 16.

For the case of acting on a roller brush 8, it is indicatively provided that the adjusting unit or valve 25 be suitable for selecting, when operating the knob 27, some working pressure values ranging between five and forty bar.

Once applied, the working pressure is substantially kept constant. Should the pressure in fact exceed the predetermined level, the small piston 26 is forced to slide further, thus compressing the adjusting spring 28 and opening up passages that determine a partial discharge of the oil and the substantial reestablishment of the working pressure set up by the knob 27.

The adjusting control 29, through which any operator running the sweeping machine 1 acts on at least one unit or adjusting valve 25, is realized by a hand-wheel associated with a graduated scale 29*a* or with indicators of a functional type, depending on the various cleaning requirements.

The hand-wheel acts through appropriate fittings on the knob 27, but the same knob 27 can also be made accessible from the steering station. A single adjusting control 29 is preferably arranged for all the units or adjusting valves 25, but it is also possible to arrange as many adjusting controls 29 as there are units 25.

In further detail, the FIGS. 2 and 3 show, in reference to the central roller brush 8, that the rotating brushes are preferably controlled by a lever 10, such as a first-type level rotating around a fulcrum 11, as outlined before.

The fulcrum 11 is arranged so as to present an axis substantially parallel to the surface to be swept 7.

The lever 10 is then provided so as to amplify the controlling action received, and for this purpose the FIGS. 2 and 3 show a lever equipped with a resistance arm —extending between the axis of rotation 8*a* of the brush and the fulcrum 11—has a length exceeding that of the power arm which extends between the fulcrum 11 and the fluid-dynamic cylinder 16.

All actuating devices or fluid-dynamic cylinders 16 outlined above have substantially the same structure.

It is in particular noted that each actuating device or fluid-dynamic cylinder 16 is connected to the fluid-dynamic system 13 by a channel 30, and is of a single-acting type.

Figure 6B:
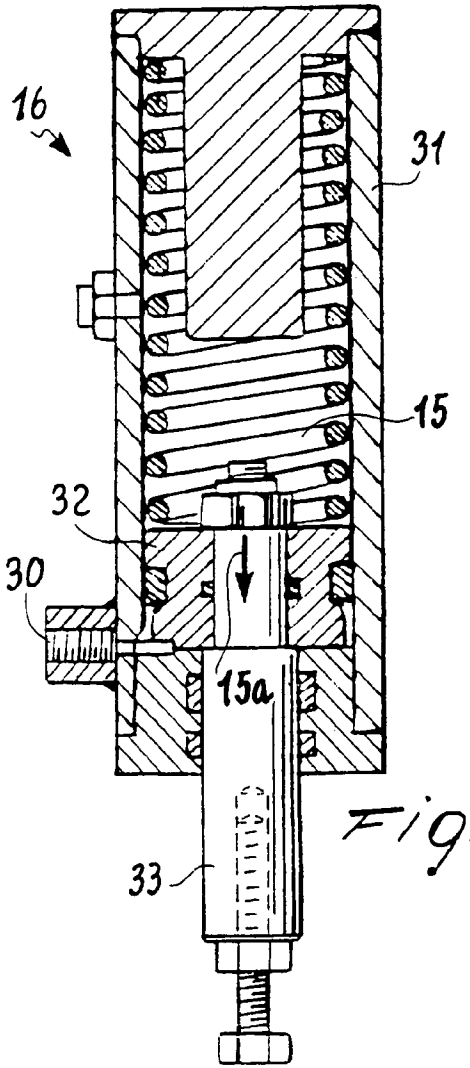
FIG. 6*b* is similar to the previous one, and shows the fluid dynamic cylinder in a second stop position.
Figure 6A:
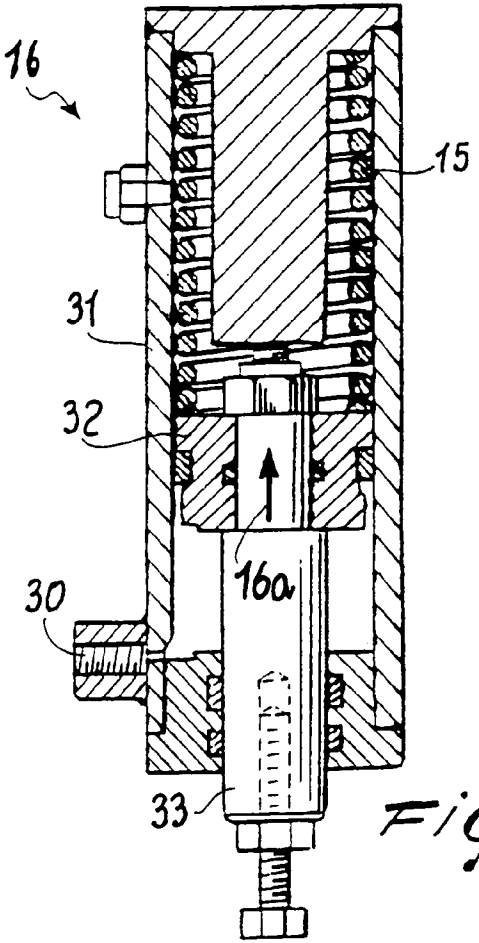
FIG. 6*a* shows the fluid dynamic cylinder outlined in the FIGS. 2, 3, 4 in a cross section and in detail in a first stop position.

As shown in particular in the FIGS. 6*a* and 6*b*, each fluid-dynamic cylinder 16 comprises a cylindrical body 31 sustained by a frame 3, a mobile piston 32 inside the cylindrical body 31, and a stem 33 firmly attached to the piston 32 and at least partially protruding from the cylindrical body 31.

The fluid-dynamic cylinder is linked to a rotating brush matching the stem 33, through an interposed lever 10.

In other words, each motion of the stem 33—in whatever direction—necessarily matches a motion of the respective brush.

As many lifting devices 15 are provided as there are fluid-dynamic cylinders 16, and these lifting devices 15 preferably consist of compression springs coaxially arranged with the respective fluid-dynamic cylinders 16.

Each compression spring is preferably housed inside a cylindrical body 31 and acting on a piston 32 in opposition to the action of the pressurized fluid. In the absence of a working pressure, each compression spring shifts the respective piston 32 and the respective stem 33 to a position of maximum extension, so as to determine a lifting of the respective rotating brush, through the lever 10, as in the case shown in FIG. 2.

The compression spring must be particularly effective, as the rotating brushes can be heavy. In the case of FIG. 2, the compression springs lifts a roller brush that can in itself, meaning without the weight of the associated fluid-dynamic motor 14*a*, have a weight of for instance about thirty kilograms.

This weight however the action of the fluid-dynamic cylinder 16, when the same forces the brush against the surface to be swept 7 and in contrast to the action of the spring, as shown in FIG. 3.

The operation of the apparatus 12 is as follows.

In order to start the work, the operator must place himself with the machine 1 on the surface of the floor to be swept or cleaned up, for instance in a shed or in a warehouse.

Provision may be made for not merely collecting dust or simple refuse such as paper, packing residues and the like, but also for cleaning up the floors from pollutants and soiling substances, including some that are difficult to remove.

On the working site the operator activates the collecting organs 4. In particular, he activates the oil circulation in the fluid-dynamic system 13, thus determining both the operation of the fluid-dynamic motors and the activation of the actuating devices or fluid-dynamic cylinders 16, and their consequent downward shifting of the rotating brushes.

While entering the fluid-dynamic cylinders 16, the oil in fact pushes the pistons 32 in a direction opposite to the lifting devices or compression springs 15, thus compressing the same and allowing the stem 33 to retract.

The rotating brushes are linked to the stem 33 and therefore forced to lower themselves and partially impinge on the surface to be swept 7 while turning.

It is evident that the pressure applied by the brushes on the floors is an essential factor in determining the degree of cleanliness.

This pressure may be adjusted in a very simple manner by the operator himself, for instance by using the adjusting control or hand-wheel 29 set on the control panel, and by acting on the knob 27 of the unit or the adjusting valve 25. The rotation of a simple hand-wheel selectively increases or decreases the working pressure in at least the actuating device or fluid-dynamic cylinder 16 that controls the most important and always available rotating brush: the roller brush 8.

The hand-wheel's position may be suggested by simple indicators such as by the graduated scale 29*a* or by simple instructions set opposite the hand-wheel itself. One position may for example be indicated for dust and refuse composed of paper, plastics and packing residues; another position for instance by liquids and moist food elements, and a final position for removing pollutants, oily substances, colours, hydrocarbon residues etc. The latter potentially adhere to the floors to be cleaned and a very robust action of the rotating brushes is therefore in order, at the highest allowable pressure acting on the floor.

In this situation no particular skill to obtain an optimum degree of cleaning is demanded from the personnel put in charge Moreover, the adjusting unit or valve 25 keeps the pre-set pressure at a constant level, the machine is therefore capable of operating correctly even in the presence of humps, steps, and differences in height. The steps and differences in height would in fact tend to compress the fluid-dynamic cylinders 16. These are however not reacting by suddenly increasing the working pressure, but by discharging the excess pressurized oil through the adjusting units or valves 25. At the end of operating it merely suffices to close the door 6*a* and to move the machine 1 toward a discharging point, after deactivating the collecting organs 4.

For this latter operation it suffices to stop the oil circulating inside the fluid-dynamic system 13; this determines both an arrest and a lifting of the brushes. The invention allows important advantages.

It allows in fact, through a simple supplementary control connected to the hand-wheel 29, to vary the brush pressure on the surface to be cleaned in accordance with certain optimum parameters.

The cleaning thus always turns out to be effective and satisfactory, even in the presence of some personnel with scant experience.

Moreover, the constraint imposed on the brushes and the possibility of adjusting and enforcing the working pressure does not impair the mobility of the brushes, which can be lifted for overcoming the obstacles.

A further asset is related to the fact that the lifts occur without losing adherence, as the working pressure remains constant.

The invention claimed is:

1. A rotating brush controlling apparatus, in a floor sweeping machine, comprising:

at least one lifting device (15) suitable for applying a lifting force (15*a*) capable of lifting a rotating brush (8) to remove the same from a surface to be swept (7); and at least one actuating device (16) suitable for applying a working force (16*a*) on command, which is opposed to said lifting force (15*a*) and exceeding the same;

a fluid-dynamic system (13) suitable for circulating a pressurized fluid, wherein said rotating brush (8) and said actuating device (16) are linked to each other, wherein some adjusting devices (24) are provided, so as to force said rotating brush (8), with a selective pressure, on said surface to be swept (7), wherein said actuating device (16) is a single-effect fluid-dynamic cylinder supplied by said fluid-dynamic system (13), and wherein said adjusting devices (24) are suitable for determining a selected working pressure in said fluid-dynamic cylinder (16), said working force (16*a*) depending on said working pressure, and wherein said lifting device (15) comprises at least one active spring opposed to said fluid-dynamic cylinder (16) and coaxial with the same.

2. An apparatus according to claim 1, wherein said adjusting devices (24) are provided to be suitable both for varying said working force (16*a*) on command, and for keeping said working force (16*a*) substantially constant in the presence of irregularities in said surface to be swept (7).

3. An apparatus according to claim 1, wherein said adjusting devices (24) comprise at least one adjusting unit (25) both suitable for varying said working force (16*a*) on command and keeping said working force (16*a*) constant in the presence of irregularities in said surface to be swept (7), and a control-wheel (29) active on said adjusting unit (25) and positioned near steering instruments of said sweeping machine.

4. An apparatus according to claim 3, wherein said adjusting unit (25) is an adjusting valve which is suitable for keeping said selected working pressure in said fluid-dynamic cylinder (16) substantially constant in the presence of irregularities in said surface to be swept (7).

5. An apparatus according to claim 3, wherein said adjusting unit (25) is an adjusting valve of a "Pressure Reducing and Relieving" type.

6. An apparatus according to claim 1, wherein said rotating brush (8) is a substantially cylindrical roller brush having a rotating axis (8*a*) which is substantially parallel to said surface to be swept (7), and wherein said rotating brush (8) and said actuating device (16) are linked to each other by at least one lever of a first type having a fulcrum (11), a power arm (10*a*) extending between said fulcrum (11) and said actuating device (16), and a resistance arm (10*b*) extending between said fulcrum (11) and said rotating brush (8), and wherein said power and resistance arms (10*a*, 10*b*) have different lengths between them.

7. An apparatus according to claim 6 wherein said resistance arm (10*b*) has a length greater than said power arm (10*a*) so as to amplify the shifts of said actuating device (16).

8. An apparatus according to claim 1, wherein said selected working pressure of said fluid in said fluid-dynamic cylinder (8) is comprised between five and forty bar.

9. An apparatus according to claim 1, wherein said fluid-dynamic cylinder (16) comprises a cylindrical body (31) held in a substantially fixed position, a piston (32) mobile in said cylindrical body (31), and a stem (33) solidly attached to said piston (32) and at least partially protruding from said cylindrical body (31), where said stem (33) is mobile along with said brush (8) and said spring is a compression spring inside said cylindrical body (31) and active on said piston (32) in opposition to said working pressure.

* * * * *